United States Patent [19]

Tamura et al.

[11] Patent Number: 4,560,907

[45] Date of Patent: Dec. 24, 1985

[54] ION SOURCE

[75] Inventors: Hifumi Tamura, Hachioji; Hiroshi Okano, Tokyo; Tohru Ishitani, Sayama; Akira Shimase, Yokohama, all of Japan

[73] Assignee: Hitachi, Ltd., Tokyo, Japan

[21] Appl. No.: 505,721

[22] Filed: Jun. 20, 1983

[30] Foreign Application Priority Data

Jun. 25, 1982 [JP] Japan ..... 57-108338

[51] Int. Cl.[4] ..... H01J 7/24; H05B 31/26

[52] U.S. Cl. ..... 315/111.01; 250/423 F; 250/427; 313/336; 313/363.1; 315/111.81

[58] Field of Search ..... 315/111.01, 111.31, 315/111.81, 111.91; 313/363.1, 360.1, 336, 337; 250/423 F, 427

[56] References Cited

U.S. PATENT DOCUMENTS

| | | | |
|---|---|---|---|
| 2,835,835 | 5/1958 | Boutry et al. | 315/111.01 |
| 3,229,157 | 1/1966 | Stevens et al. | 315/111.91 |
| 3,775,630 | 11/1973 | Minamikawa et al. | 313/336 |
| 3,890,535 | 6/1975 | Gautherin et al. | 315/111.01 |
| 3,928,783 | 12/1975 | Hosoki et al. | 313/346 R |
| 4,019,077 | 4/1977 | Sakitani | 313/336 |
| 4,318,029 | 3/1982 | Jergenson | 315/111.81 |
| 4,453,078 | 6/1984 | Shimizu | 250/427 |

FOREIGN PATENT DOCUMENTS

EP0037455 10/1981 European Pat. Off. ..... 315/111.81

*Primary Examiner*—Saxfield Chatmon

*Attorney, Agent, or Firm*—Antonelli, Terry & Wands

[57] ABSTRACT

An ion source apparatus of surface ionization type comprises an emitter tip in the form of a round rod having a sharp-pointed end, an ion source material holder for holding the emitter tip coaxially within a crucible made of a material of a high melting point, the crucible having an opening formed in a bottom wall thereof through which the sharp-pointed end of the emitter tip extends outwardly, the ion source material is being filled in the crucible so as to enclose the outer periphery of the sharp-pointed end of the emitter tip, a filament for emitting electrons with which the emitter tip is bombarded from below, a heating power supply for the filament, an ion beam extracting electrode disposed between the emitter tip and the filament and maintained at a potential of a substantially the level as that of the filament, and an accelerating voltage power supply for applying a high voltage between the ion beam extracting electrode and the emitter tip to accelerate the electrons and ion beam.

14 Claims, 4 Drawing Figures

ION SOURCE

BACKGROUND OF THE INVENTION

The present invention relates to an ion source apparatus and, more particularly, to an ion source apparatus of electron-bombardment field-emission type in which an ion source material is heated to cause surface ionization thereby producing an ion beam through an applied electric field of a high strength.

An ion source of the aforementioned type may be used for fabrication of submicro-structures of LSIs (Large Scale Integrated Circuits), the measurements of the order of sub-microns in secondary ion mass spectrometry and others.

Surface ionization type ion sources have been proposed which include a resistance heater and an emitter tip coupled to the heater, with an ion source material being supplied to the coupled portion. The emitter tip may be either a sharp-pointed end member or be fashioned as a porous structure.

Disadvantages of the proposed prior art ion systems reside in the fact that such systems generally exhibit poor heating deficiency characteristics. To improve the heating efficiency, it is necessary to maintain the ion source material at a temperature higher than the melting point; however, such approach results in an evaporation of the ion source material resulting in a wastage or consumption of the source material as well as a contamination of the environment.

Additionally, in extreme cases, the evaporated ion source material may be deposited on a high voltage insulation resulting in an electrical breakdown and thereby adversely shortening the useful service life of the ion source and degrading the realiability of the ion source apparatus.

A further disadvantage of problem encountered in the prior art ion source apparatus resides in the fact that reaction of the ion source material with a heater material may occur, since electrically conductive materials, in general exhibit increased tendency for mutual reaction and are likely to be molten at relatively low temperatures. Further, a reaction with the material of the emitter tip may also take place. Consequently, not only is the sharp-pointed end of the emitter tip dulled, but also the wastage or dissipation of the tip material becomes significant. Under the circumstances, there is imposed restriction on the types of ions which are allowed to be extracted as the ion beam.

A further crucial problem common to the prior art ion sources which operate on the heat transfer principle resides in the fact that a selection of the emitter tip material from the electrically conductive materials is indispensably required notwithstanding the fact that the electrically conductive materials present the problem of the reaction mentioned above. Besides, the resistance heating provides an obstacle to the attempt for increasing the temperature of the emitter tip.

It is an object of the present invention to provide an ion source apparatus which avoids the disadvantages and difficulties encountered in prior art ion sources and which is capable of reducing the wastage of the ion source material and environmental contamination, increasing the number or types of ions to be produced, extending a service life of the ion source apparatus, and enhancing the reliability thereof.

In view of the above object, in accordance with the present invention an ion source apparatus is provided which includes a round rod-like emitter tip having a sharp-pointed end, with an ion source material holder for holding the emitter tip coaxially within a crucible made of a material having a high melting point. The crucible has an opening formed in the bottom wall thereof through which the sharp-pointed end of the emitter tip extends to the exterior, with an ion source material being filled around the outer periphery of the sharp-pointed end of the emitter tip. A filament emits an electron beam for bombarding the emitter tip with electrons from below, and a heating power supply is provided for the filament. An ion beam extracting electrode is disposed between the emitter tip and is the filament and maintained at a substantially same potential as the filament accelerating voltage power supply applies a high voltage between the beam extracting electrode and the emitter tip to accelerate the electrons and the ion beam.

By virtue of arrangement in accordance with the present invention, the sharp-pointed end of the emitter tip is heated directly by the electron bombardment or electron rays, whereby an improved heating efficiency can be achieved as compared with the prior art resistance heating. Furthermore, due to the heating through electron bombardment, a high temperature of 3000° C. or more can be easily attained. Moreover, a structure in which the ion source material is held within the crucible at a lower portion thereof permits wastage or loss of the ion source material due to evaporation to be significantly reduced as compared with that of the prior art ion sources. Additionally, protection is provided against the environmental or ambient contamination or pollution due to atom vapor. Also, since, in accordance with the invention, an insulation material of a low thermal conductivity can be used as the material for the emitter tip, the heating efficiency can be enhanced while the reaction with the ion source material can be avoided. Furthermore, by virtue of the two superposed ionization mechanisms of the surface ionization and the electron bombardment, an ion beam of an increased intensity can be produced with an ion source constructed in accordance with the present invention.

DETAILED DESCRIPTION

Figure 1A:
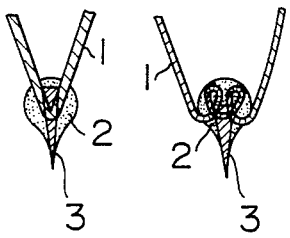
FIG. 1A PRIOR ART
FIGS. 1A and 1B are cross-sectional views of main portions of prior art ion source apparatus of the surface ionization type.
Figure 1B:
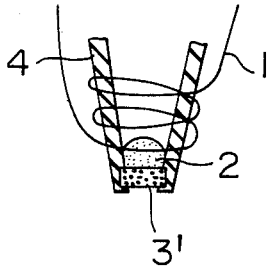
FIG. 1B PRIOR ART

Referring now to the drawings wherein like reference numerals are used throughout the various views to designate like parts and, more particularly, to FIG. 1A, according to this figure, a prior art ion source includes a resistance heater 1 in the form of a hairpin or cone, an emitter tip 3 coupled to the heater 1 and having a sharpened or sharp-pointed end, and an ion source material 2 supplied to the coupled portion. As shown in FIG. 1B, another ion source of the prior art includes a resistance heater 1, an ion source material 2, an emitter 3' of a porous structure which corresponds to the emitter tip 3 of the ion source of FIG. 1, and a crucible 4. Ion extraction electrodes (not shown) are also provided for the ion sources of FIGS. 1A and 1B. The emitter tip 3 and the emitter 3' are made of a tungsten (W) material in a porous structure so that the ion source material may penetrate through the porous mass onto the surface of the tungsten tip 3 of the emitter 3'.

The ion sources of FIGS. 1A and 1B operate in the following manner.

At first, the resistance heater 1 is electrically energized to heat and melt the ion source material 2 so that the ion source material 2 may be fed to the emitter tip 3 or the emitter 3'. Subsequently, a high voltage is applied to the emitter tip 3 or the emitter 3' for extracting a beam of ions through surface ionization. In the ion source structure shown in FIG. 1A, the emitter tip 3 is directly bonded to the resistance heater 1, whereby the emitter tip 3 can be heated due to thermal conductivity. In the operating state, the ion source material 2 is continuously fed to the sharp-pointed end of the emitter tip 3, with the high voltage being supplied thereto, and ions produced through the surface ionization are emitted from the sharp-pointed end of the emitter tip 3. With the ion source shown in FIG. 1B, an indirect heating structure is employed in which the crucible for containing the ion source material 2 is heated by the resistance heater 1. Through the surface ionization mechanism, ions are emitted from the emitter 3'.

In both of the ion sources illustrated in FIGS. 1A and 1B, the heating of the emitter tip 3 and the emitter 3' is effected indirectly by making use of heat conduction. With the ion source shown in FIG. 1A, the temperature of the sharp-pointed end of the emitter tip 3 is slightly lower than the melting point of the ion source material 2. Accordingly, in order to assure that the ion source material 2 is constantly supplied to the sharp-pointed end of the emitter tip 3, the bonding portion between the heater 1 and the emitter tip 3, which serves as a reservoir for the ion source material 2, has to be maintained at a temperature higher than the melting point. However, in this state, evaporation of the ion source material 2 in the reservoir is extremely great as compared with evaporation at the sharp-pointed end of the emitter tip 3 resulting in the problems noted hereinabove, namely, consumption of the ion source material, environmental contamination, and electrical breakdown. Since the ion source structure shown in FIG. 1B is of the indirect heating type in the strict sense, there is a limitation on the heating temperature of the ion source material 2, thereby making it difficult to employ an element of a high melting point as the ion source material 2.

Figure 2:
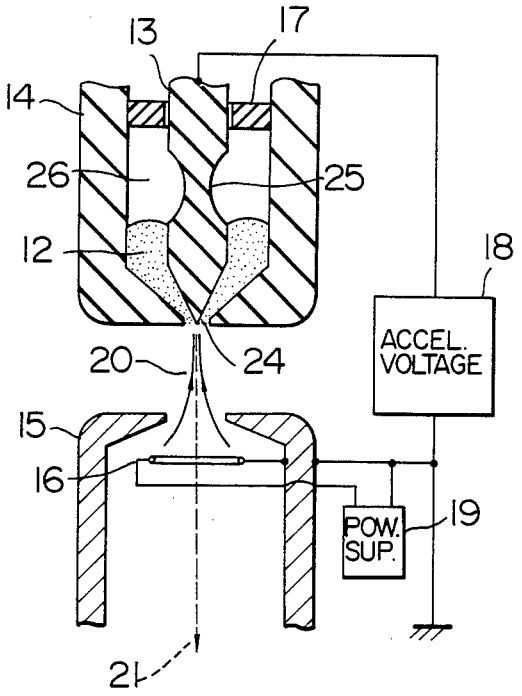
FIG. 2 is a partially schematic cross-sectional view of a surface ionization type ion source apparatus according to an embodiment of the invention.

As shown most clearly in FIG. 2, according to the present invention, an ionization type ion source apparatus includes an ion source material 12, an emitter tip 13 and a crucible 14, with the crucible 14 being made of a material having a high melting point and is being less susceptible to a reaction. The emitter tip 13 is fashioned as a round rod having a lower end sharpened and held coaxially within the crucible 14. An opening 24 is formed in the bottom wall of the crucible 14, with the sharp-pointed end of the emitter tip 13 extending outwardly through the opening 24. The ion source material 12 is filled in the crucible 14 at a lower portion thereof so that the outer periphery of the sharp-pointed end of the emitter tip 13 is enclosed by the ion source material 12. A constriction or neck 25 of a reduced diameter is formed in the emitter tip 13 to increase the thermal resistance. To enable an axial alignment of the emitter tip 13, a plate-like doughnut 17 is provided. Although in the illustrated embodiment, only one doughnut 17 is used, as can readily be appreciated, a plurality of doughnuts 17 may be provided depending upon a particular application of the apparatus. The emitter tip 13, crucible 14 and doughnut 17 cooperate to form an ion source material holder structure 26.

As shown in FIG. 2, a filament 16 is provided for emitting electrons for bombarding the emitter tip 13 with electrons from below, with a heating power supply 19 being provided for the filament 16. An ion beam extracting electrode 15 is disposed between the emitter tip 13 and the filament 16 and is electrically connected to the filament 16. An accelerating voltage power supply applies a high voltage between the ion beam extracting electrode 15 and the emitter tip 13 to accelerate the electron beam directed from the filament 16 to the emitter tip 13 and an ion beam extracted or removed from the emitter tip 13.

In operation, the filament 16 is first heated through electrical energization from the heating power supply 19 and, subsequently a high voltage is applied between the emitter tip 13 and the ion beam extracting electrode 15 from the accelerating voltage power supply 18. In this case, the strength of the electric field as applied can be finely adjusted through corresponding fine adjustment of the vertical position of the emitter tip 13. Thus, the sharp-pointed end of the emitter tip 13 is bombarded with electrons 20 emitted from the filament 16, resulting in the sharp-pointed end of the emitter tip 13 being heated. As the sharp-pointed end of the emitter tip 13 is heated up, the ion source material 12 is heated through conduction of heat to be molten, resulting in the ion source material 12 being continuously fed to the sharp-pointed end of the emitter tip 13. Since the sharp-pointed end of the emitter tip 13 is heated, the ion source material 12 undergoes ionization to thereby allow the ion beam 21 to be extracted.

The material for the emitter tip 13 is selected in consideration of the work function, melting point, reaction ability and the like of the ion source material 12. However, considering the fact that metals in general are very susceptible to mutual reaction and that the reaction product or compound exhibits a lower melting point than metal element, it is regarded that metal is not suitable for the material of the emitter tip 13.

In the case of the instant embodiment, the emitter tip 13 is made of an insulation material such as oxide which is less susceptible to reaction, with the insulation material being, for example, quartz, aluminum oxide ($Al_2O_3$), sapphire or the like and the surface of the emitter tip 13 is previously coated with a material such as, for example, W, Ta or the like, so that the ion source material 12, supplied separately, may undergo the surface ionization in a stable manner while a reaction of the material of the emitter tip 13 with the ion source material 12 is avoided. The coating applied to the surface of the emitter tip 13 also provides a means for enhancing the surface ionization. The coating is satisfactory in thickness of the order of 1000 Å or less. The emitter tip 13 of the coated insulation material according to the invention can not only assure a significantly improved heating efficiency as compared with the emitter tip made of metal but also reduction in power consumption.

The crucible 14 may be made of a metallic material or an insulation material depending upon the contemplated applications. More specifically, when a material of a high melting point is to be used as the ion source material 12, the crucible 14 should preferably be made of an insulation material such as, for example, quartz with a view toward decreasing thermal loss due to heat conduction. The doughnut 17 provided for the axial alignment of the emitter tip 13 also serves for preventing evaporated atoms from being spattered outwardly and is effective for reducing the loss of ion source material 12 through evaporation and preventing contamination of the ambience.

Figure 3:
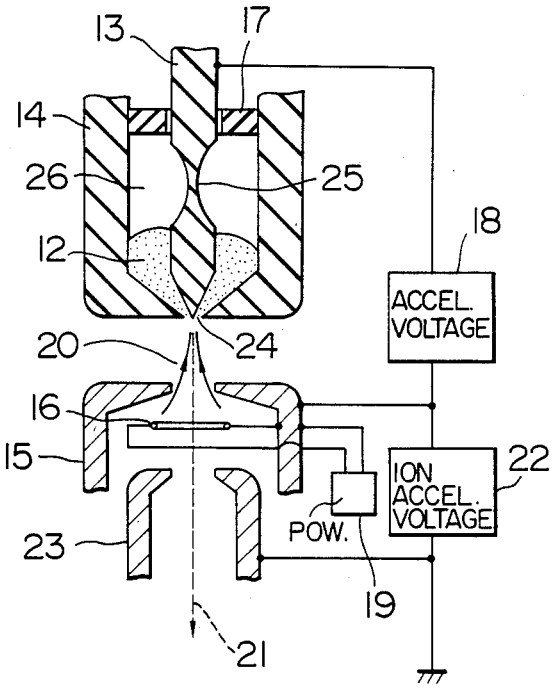
FIG. 3 is a partially schematic cross-sectional of a surface ionization type ion source apparatus according to another embodiment of the present invention.

The embodiment of FIG. 3 differs from FIG. 2 in that an ion beam accelerating electrode 23 is additionally provided below the filament 16 and an ion accelerating voltage power supply 22 is added for applying an ion accelerating voltage between the ion accelerating electrode 23 and the ion beam extracting electrode 15, so that energy of the ion beam 21 can be arbitrarily varied by controlling the accelerating voltage. Except for this difference, the structure as well as operation of the ion source shown in FIG. 3 is similiar to those of the apparatus shown in FIG. 2.

In order to regulate the amount of the ion source material flowing down through the opening 24, the emitter tip 13 may be supported by the following structure.

The top end of the emitter tip 13 is attached to a plate, not shown, by supporting threaded bolts are provided each of which has two nuts threadably mounted the respective bolts. The plate is held firmly at its two portions between each pair of the nuts which are adjustable along a length of the respective bolts so as to enable a vertical adjustment of the emitter tip 13.

We claim:

1. An ion source apparatus in which an ion source material is heated for effecting surface ionization to extract an ion beam through a high strength electric field, the ion source apparatus comprising: an emitter tip in the form of a round rod having a sharp-pointed end; an ion source material holder for holding said emitter tip coaxially within a crucible made of a material of a high melting point, said crucible having an opening formed in a bottom wall thereof through which the sharp-pointed end of said emitter tip extends, said ion source material filling said crucible so as to enclose an outer periphery of said sharp-pointed end of said emitter tip; a filament disposed below the emitter tip for emitting electrons to bombard said emitter tip so as to heat said emitter tip as a result of the bombardment by the electrons; a heating power supply for heating said filament; an ion beam extracting electrode disposed between said emitter tip and of said filament and maintained at substantially a same potential as said filament; and an accelerating voltage power supply for applying a high voltage between said ion beam extracting electrode and said emitter tip to accelerate said electrons and said ion beam.

2. An ion source apparatus according to claim 1, wherein said emitter tip has a neck of a reduced cross-section area formed in the vicinity of the sharp-pointed end of said emitter tip.

3. An ion source apparatus according to claim 1, wherein said emitter tip is made of an insulation material and has a surface applied with a material having a high level work function in a thin film.

4. An ion source apparatus according to claim 1, wherein said emitter tip is vertically movable relative to the bottom of said crucible in which said emitter tip is held coaxially.

5. An ion source apparatus according to claim 1, further comprising an ion beam accelerating electrode provided beneath said filament for applying an electric field to said ion beam.

6. An ion source apparatus according to claim 1, further comprising means for increasing a thermal resistance of the emitter tip.

7. An ion source apparatus according to claim 1, further comprising means for axially aligning the emitter tip in said crucible and for preventing evaporated atoms from the ion source material from escaping into the emvironment.

8. An ion source apparatus according to claim 7, wherein said means for axially aligning and for preventing evaporated ions from escaping includes at least one doughnut shaped member mounted at an upper portion of the crucible.

9. An ion source apparatus according to claim 8, further comprising means for increasing a thermal resistance of the emitter tip.

10. An ion source apparatus according to claim 1, further comprising means for controlling an energy of the ion beam.

11. An ion source apparatus according to claim 10, wherein said means for controlling is disposed below the filament.

12. An ion source apparatus according to claim 11, wherein said means for controlling includes an ion beam accelerating electrode and an ion accelerating voltage power means connected thereto.

13. An ion source apparatus according to claim 12, further comprising means for increasing a thermal resistance of the emitter tip.

14. An ion source apparatus according to claim 13, further comprising means for axially aligning the emitter tip in said crucible and for preventing evaporated atoms for the ion source material from escaping into the environment.

* * * * *